US011385568B2

(12) United States Patent
Chuang

(10) Patent No.: US 11,385,568 B2
(45) Date of Patent: Jul. 12, 2022

(54) LINKING MECHANISM FOR TONER CARTRIDGE

(71) Applicant: GENERAL PLASTIC INDUSTRIAL CO., LTD., Taichung (TW)

(72) Inventor: Chin-His Chuang, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 16/920,746

(22) Filed: Jul. 5, 2020

(65) Prior Publication Data

US 2021/0341854 A1 Nov. 4, 2021

(30) Foreign Application Priority Data

May 1, 2020 (TW) ..... 109114732

(51) Int. Cl.
*G03G 15/08* (2006.01)

(52) U.S. Cl.
CPC ..... *G03G 15/087* (2013.01)

(58) Field of Classification Search
CPC ..... G03G 15/087; G03G 15/0886
See application file for complete search history.

(56) References Cited

U.S. PATENT DOCUMENTS

| | | | | |
|---|---|---|---|---|
| 10,591,865 | B2 * | 3/2020 | Gamo | G03G 21/1647 |
| 10,725,400 | B2 * | 7/2020 | Gamo | G03G 15/0879 |
| 2012/0163877 | A1 | 6/2012 | Kikuchi et al. | |

* cited by examiner

*Primary Examiner* — Arlene Heredia
(74) *Attorney, Agent, or Firm* — CKC & Partners Co., LLC

(57) ABSTRACT

A linking mechanism for a toner cartridge includes a cover, a horizontal sliding portion and a tilt sliding portion. The cover has an accommodating space for disposing a toner cylinder. The horizontal sliding portion is horizontally slidden when the toner cartridge is installed or disassembled, and is slidably connected to the cover. When the horizontal sliding portion is slidden, the tilt sliding portion is linked to rise or decline.

7 Claims, 12 Drawing Sheets

LINKING MECHANISM FOR TONER CARTRIDGE

RELATED APPLICATIONS

This application claims priority to Taiwan Application Serial Number 109114732, filed May 1, 2020, which is herein incorporated by reference.

BACKGROUND

Technical Field

The present disclosure relates to a linking mechanism. More particularly, the present disclosure relates to a linking mechanism for a toner cartridge.

Description of Related Art

In recent years, because the technique has developed rapidly, electronic imaging devices such as printers, copy machines, fax machines and so on have been full of lives of modern people whether at home or at work. Furthermore, a linking mechanism disposed in the electronic imaging devices plays a main role in transmitting a toner. Hence, the linking mechanism is one of the main factors influencing the imaging effect of the electronic imaging devices.

In particular, how to precisely align a toner outlet of a toner cylinder to a toner inlet of the electronic imaging device and how to make the toner smoothly discharged from the toner cylinder are the goals of improving a design of the electronic imaging device.

SUMMARY

According to one aspect of the present disclosure, a linking mechanism for a toner cartridge includes a cover, a horizontal sliding portion and a tilt sliding portion. The cover has an accommodating space for disposing a toner cylinder. The horizontal sliding portion is horizontally slidden when the toner cartridge is installed or disassembled, and is slidably connected to the cover. When the horizontal sliding portion is slidden, the tilt sliding portion is linked to rise or decline.

DETAILED DESCRIPTION

Figure 1:
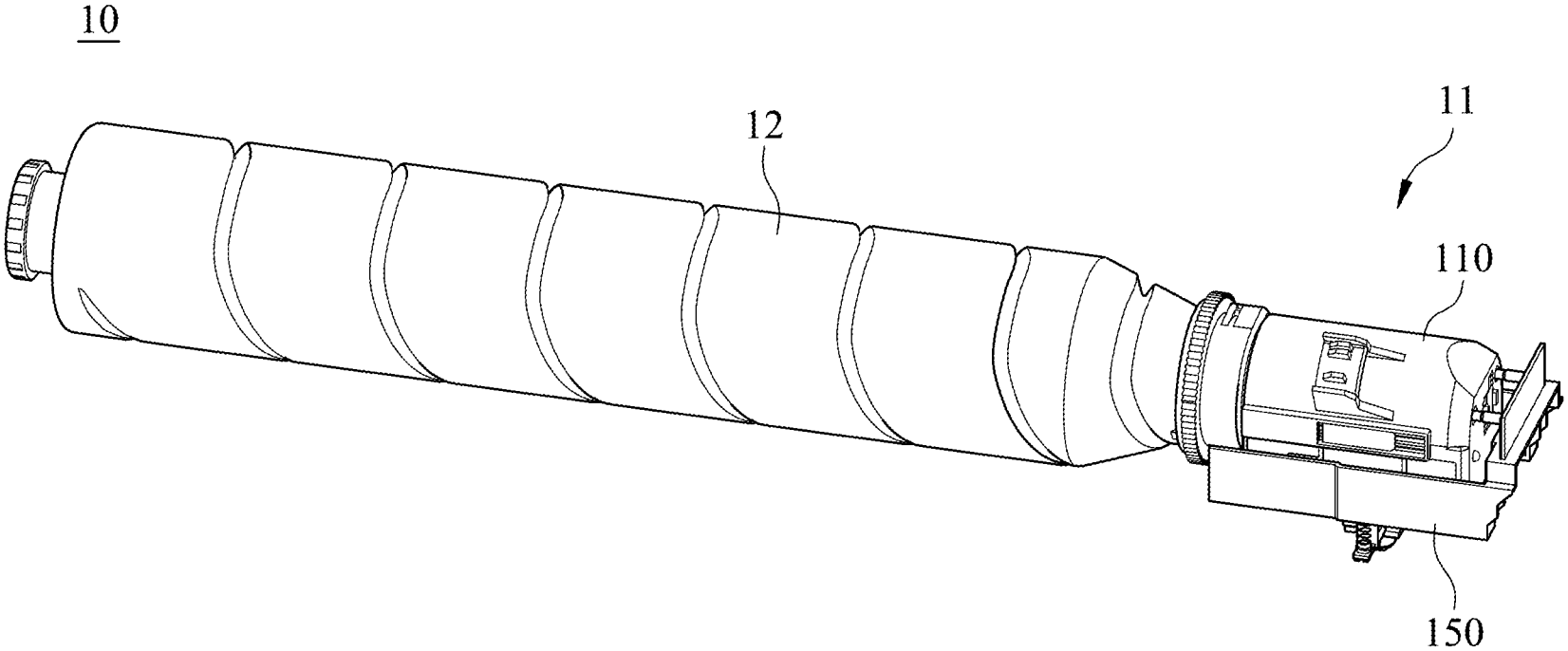
FIG. 1 is a schematic view of a linking mechanism for a toner cartridge according to one embodiment of the present disclosure.
Figure 2:
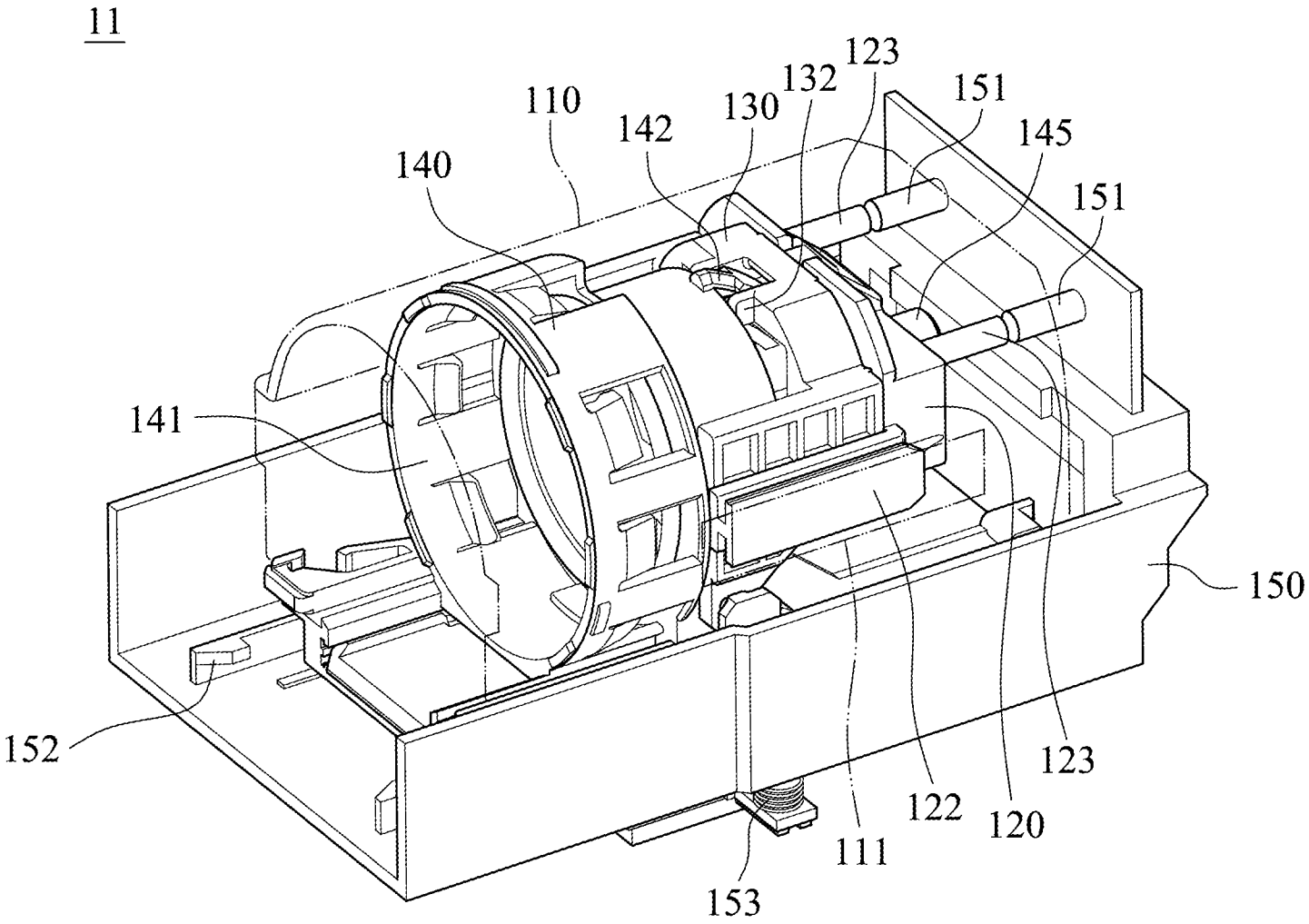
FIG. 2 is an assembling schematic view of the linking mechanism according to the embodiment of FIG. 1.

FIG. 1 is a schematic view of a linking mechanism 11 for a toner cartridge 10 according to one embodiment of the present disclosure. FIG. 2 is an assembling schematic view of the linking mechanism 11 according to the embodiment of FIG. 1. In FIGS. 1 and 2, the linking mechanism 11 is the linking mechanism 11 for the toner cartridge 10, wherein the toner cartridge 10 includes a toner cylinder 12 and the linking mechanism 11, the toner cylinder 12 is for accommodating a toner (not shown), and the linking mechanism 11 is for linking a discharge of the toner.

Figure 3:
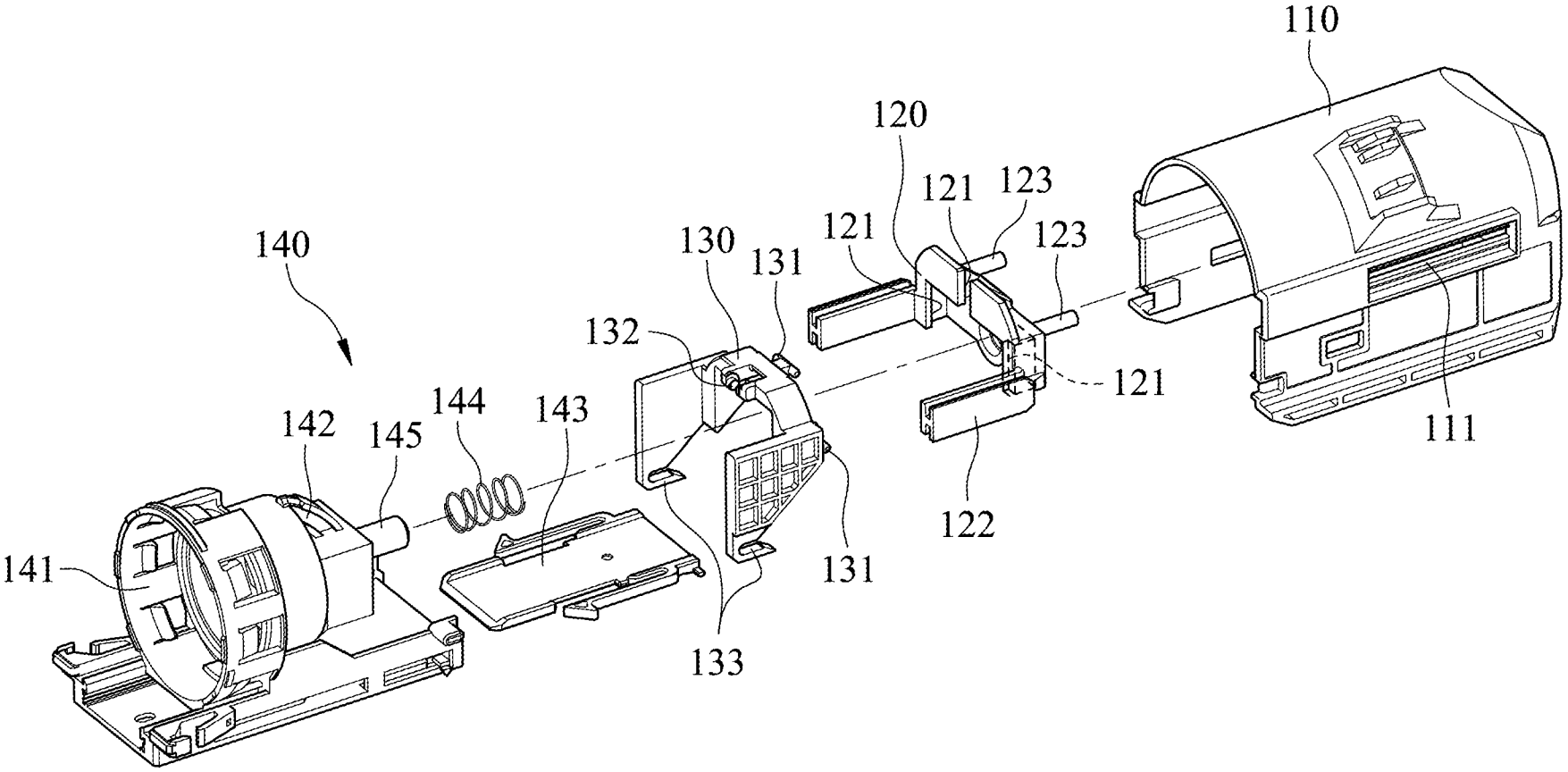
FIG. 3 is a partially exploded view of the linking mechanism according to the embodiment of FIG. 1.
Figure 4:
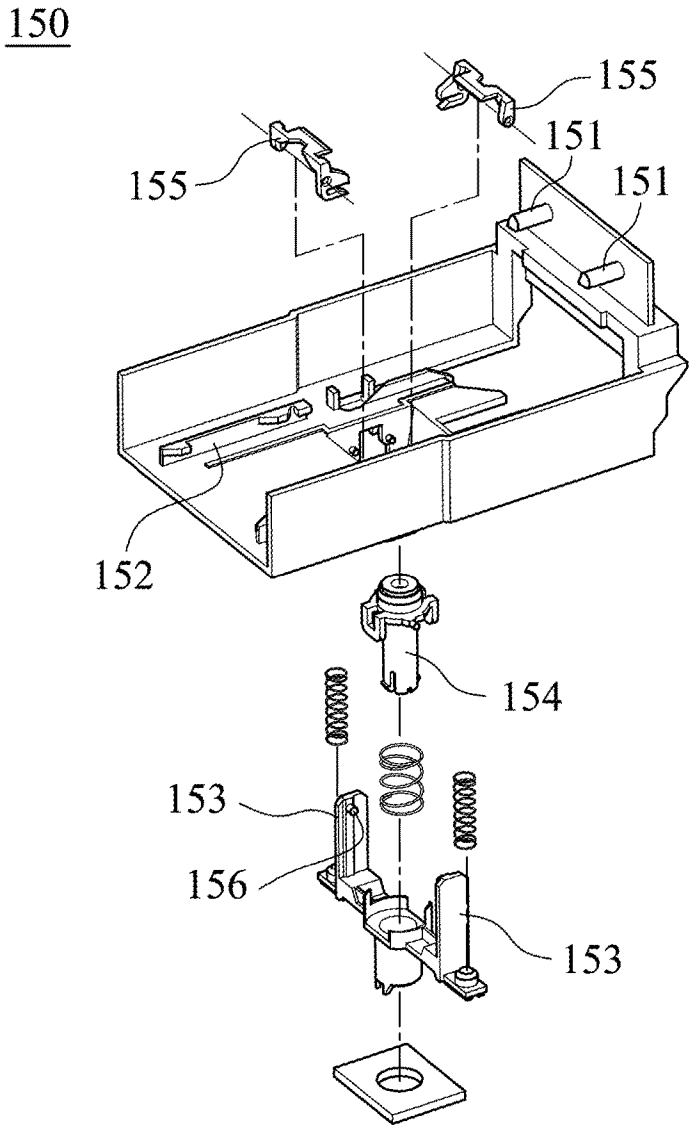
FIG. 4 is an exploded view of a transmission module according to the embodiment of FIG. 1.

FIG. 3 is a partially exploded view of the linking mechanism 11 according to the embodiment of FIG. 1. FIG. 4 is an exploded view of a transmission module 150 according to the embodiment of FIG. 1. In FIGS. 1 to 4, the linking mechanism 11 includes a cover 110, a horizontal sliding portion 120, a tilt sliding portion 130, a cover body 140 and the transmission module 150. Moreover, in FIGS. 2 and 3, the cover 110 has an accommodating space (its reference numeral is omitted) for disposing the toner cylinder 12, the horizontal sliding portion 120, the tilt sliding portion 130 and the cover body 140. The horizontal sliding portion 120 is horizontally slidden when the toner cartridge 10 is installed or disassembled, and is slidably connected to the cover 110. When the horizontal sliding portion 120 is slidden, the tilt sliding portion 130 is linked to rise or decline. Therefore, it is favorable for linking the discharge of the toner in the toner cylinder 12.

Figure 5:
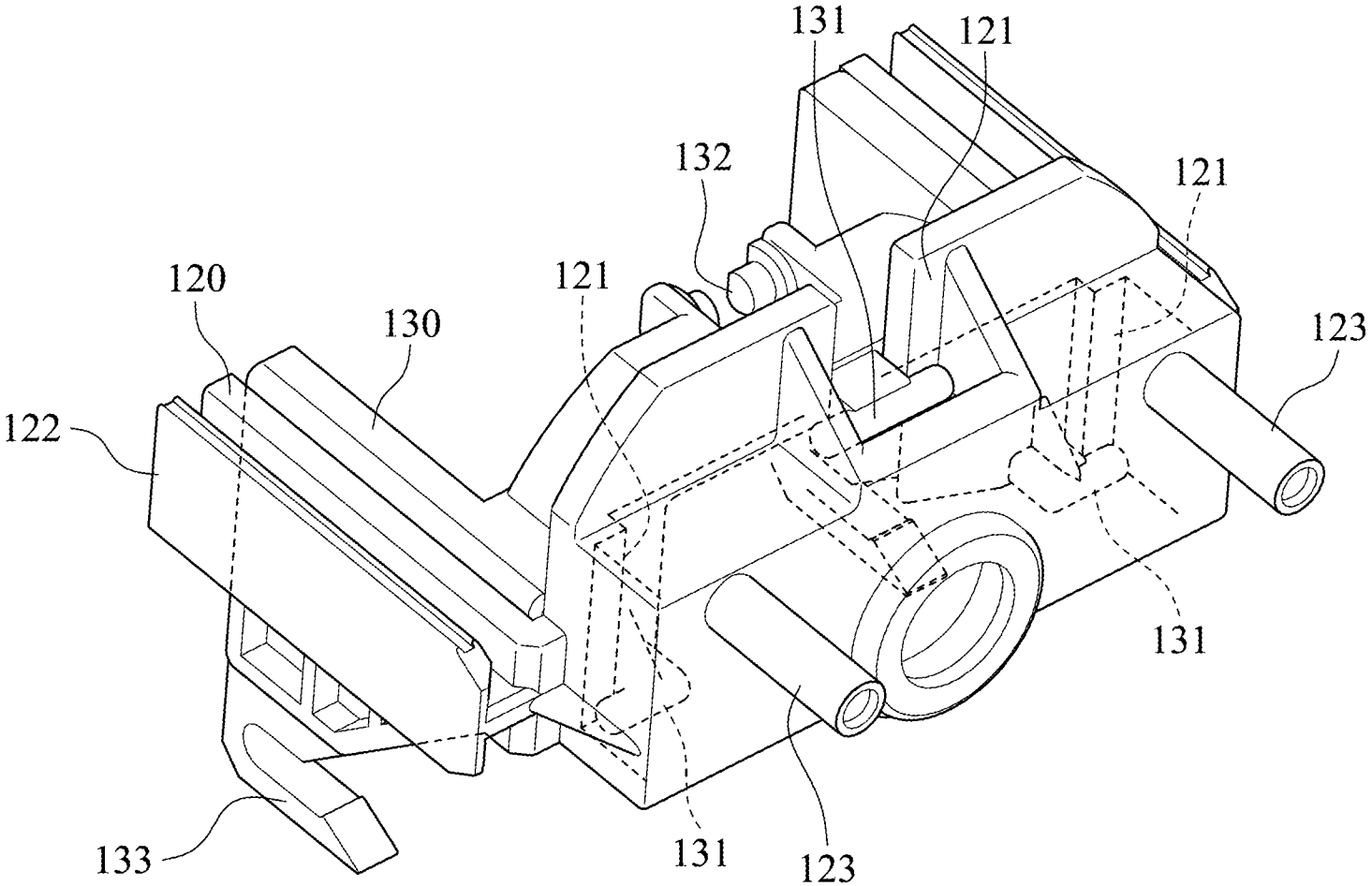
FIG. 5 is an assembling schematic view of the horizontal sliding portion and the tilt sliding portion according to the embodiment of FIG. 1.

FIG. 5 is an assembling schematic view of the horizontal sliding portion 120 and the tilt sliding portion 130 according to the embodiment of FIG. 1. In FIGS. 2, 3 and 5, the tilt sliding portion 130 includes at least one first engaging structure 131, the horizontal sliding portion 120 includes at least one second engaging structure 121, and the second engaging structure 121 is slidably connected to the first engaging structure 131. Therefore, the horizontal sliding portion 120 can be smoothly assembled with the tilt sliding portion 130, and the horizontal sliding portion 120 is not easily to be separated from the tilt sliding portion 130 during linking with each other. In detail, according to the embodiment of FIG. 5, a number of the first engaging structures 131 is three, a number of the second engaging structures 121 is three, and the number and a position of the first engaging structures 131 are corresponding to the number and a position of the second engaging structures 121. Therefore, it is favorable for the horizontal sliding portion 120 to be assembled with the tilt sliding portion 130. Further, a form of the first engaging structures 131 is a retaining end, and a form of the second engaging structures 121 is a track; or, the form of the first engaging structures 131 and the form of the second engaging structures 121 can be reversed or be other forms. It should be mentioned that the positions, the numbers and the forms of the first engaging structures 131 and the second engaging structures 121 are not limited thereto.

In FIGS. 2 and 3, the cover 110 can include at least one track 111 disposed on the cover 110, and the horizontal sliding portion 120 can further include at least one slideway portion 122 slidably disposed on the track 111 of the cover 110. Therefore, it is favorable for enhancing a stability of the horizontal sliding portion 120 horizontally slidden on the cover 110. In particular, a number of the tracks 111 is two, and the tracks 111 of the cover 110 can be disposed on two sides of the cover 110. A number of the slideway portions 122 is two. The number and a position of the slideway portions 122 are corresponding to the number and a position of the tracks 111 of the cover 110, but are not limited thereto.

Therefore, because the horizontal sliding portion 120 is slidably connected to the cover 110, the horizontal sliding portion 120 can be horizontally slidden by the toner cartridge 10 installed or disassembled, and the tilt sliding portion 130 can be linked to rise or decline. Further, according to the aforementioned embodiment, the tracks 111 of the cover 110 are relatively connected to the slideway portions 122 of the horizontal sliding portion 120, and the second engaging structures 121 are engaged to and connected to the first engaging structures 131, so that it is favorable for enhancing the stability of the operation between the horizontal sliding portion 120 and the tilt sliding portion 130 when the toner cartridge 10 is installed or disassembled.

Figure 6:
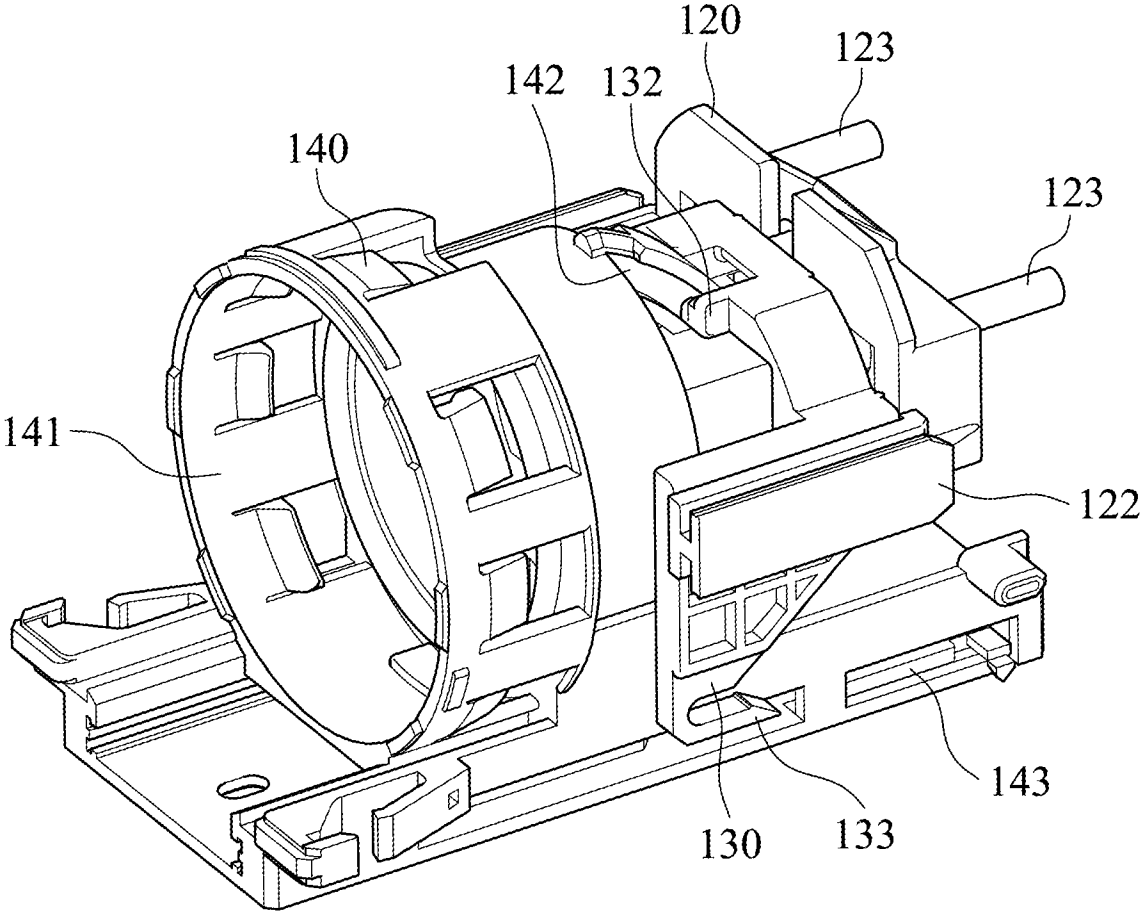
FIG. 6 is an assembling schematic view of the horizontal sliding portion, the tilt sliding portion and the cover body according to the embodiment of FIG. 1.

FIG. 6 is an assembling schematic view of the horizontal sliding portion 120, the tilt sliding portion 130 and the cover body 140 according to the embodiment of FIG. 1. In FIGS. 2, 3 and 6, the cover body 140 can have a hollow tunnel portion 141 for connecting to the toner cylinder 12. Furthermore, the cover body 140 can include a track structure 142 disposed on a top of an outer side of the cover body 140, and the tilt sliding portion 130 can further include a sliding structure 132 slidably connected to the track structure 142 of the cover body 140. By a relative disposition and connection between the track structure 142 and the sliding structure 132, it is favorable for the tilt sliding portion 130 to be stably linked to rise or decline along the track structure 142 by the horizontal sliding portion 120. According to the embodiment of FIG. 6, the track structure 142 of the cover body 140 can be a circular track, and the sliding structure 132 of the tilt sliding portion 130 can be slidden in a tilting direction along a circular orbit of the track structure 142 of the cover body 140 (please refer to a direction B indicated on FIG. 11).

Moreover, the cover body 140 can further include a cylindrical front end 145 disposed through an opening (its reference numeral is omitted) of the horizontal sliding portion 120, and a spring 144 is disposed between the cylindrical front end 145 and the opening. In detail, when the toner cartridge 10 is installed, the spring 144 is compressed; when the toner cartridge 10 is disassembled, the spring 144 is restored, and it is favorable for recovering the position of the horizontal sliding portion 120.

In FIGS. 2 and 4, the transmission module 150 is disposed on an outer side of the cover 110 for linking the horizontal sliding portion 120 to horizontally slide. In detail, the horizontal sliding portion 120 can further include at least one first abutting member 123, the transmission module 150 can include at least one second abutting member 151 corresponding to the first abutting member 123, and the first abutting member 123 is disposed through the cover 110. Hence, the horizontal sliding portion 120 can be linked to horizontally slide by the first abutting member 123 of the horizontal sliding portion 120 abutted via the second abutting member 151 of the transmission module 150. In particular, according to the embodiment of FIG. 2, a number of the first abutting members 123 is two, a number of the second abutting members 151 is two, and the number and a position of the first abutting members 123 are corresponding to the number and a position of the second abutting members 151. The numbers and the positions of the first abutting members 123 and the second abutting members 151 are not limited thereto.

Figure 7:
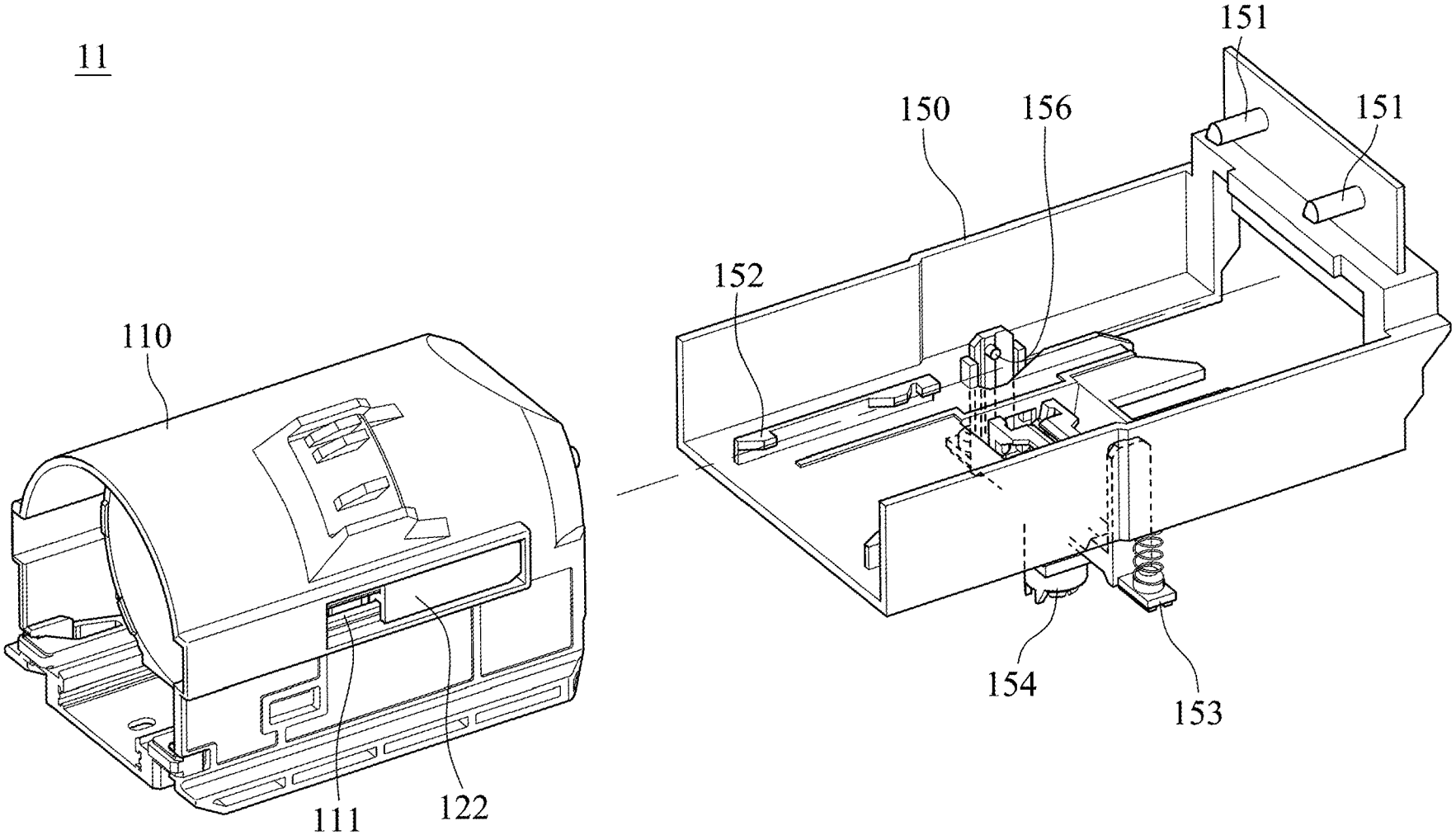
FIG. 7 is an assembling schematic view of the cover and the transmission module according to the embodiment of FIG. 1.
Figure 8:
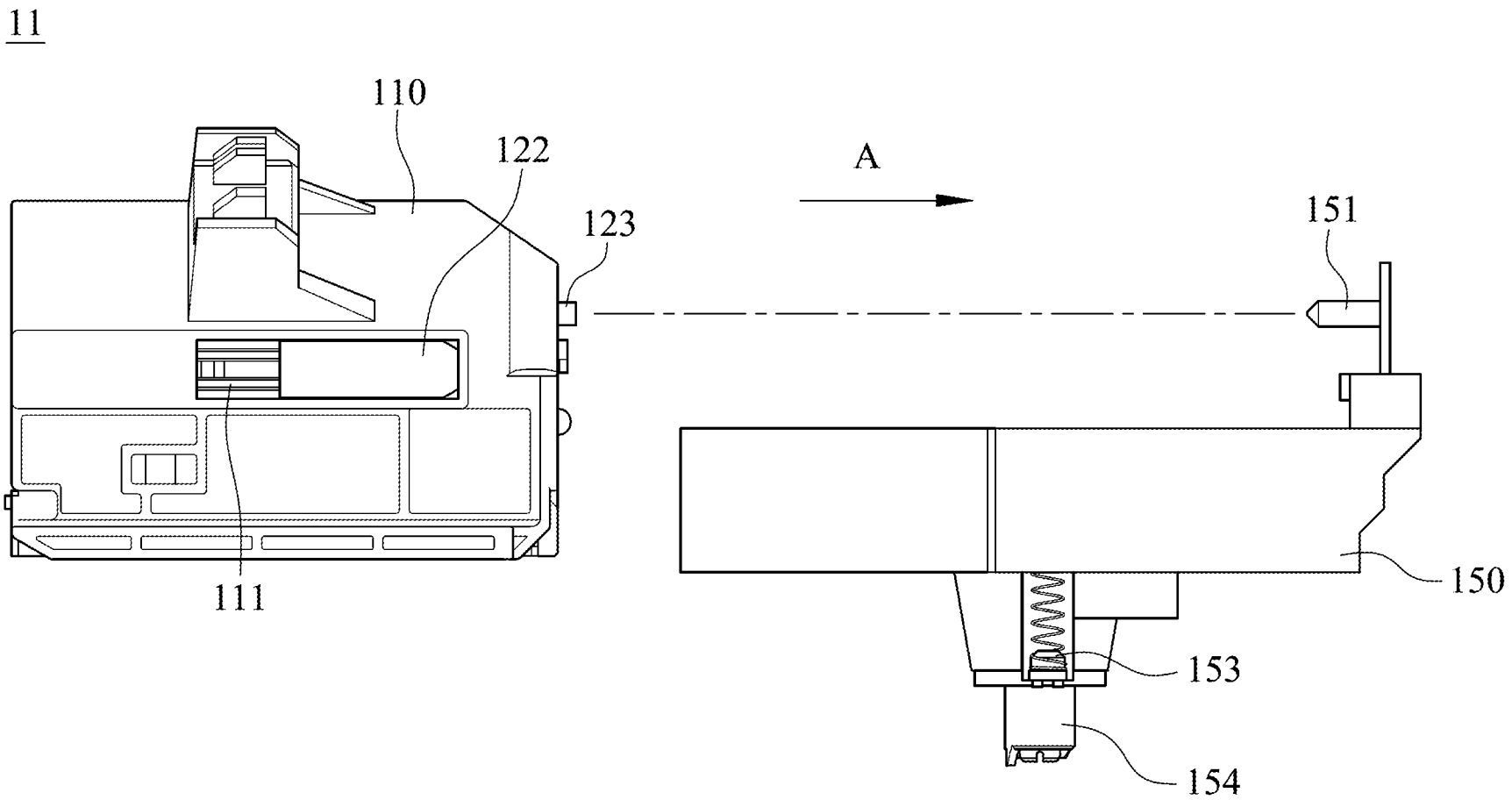
FIG. 8 is another assembling schematic view of the cover and the transmission module according to the embodiment of FIG. 1.

FIG. 7 is an assembling schematic view of the cover 110 and the transmission module 150 according to the embodiment of FIG. 1. FIG. 8 is another assembling schematic view of the cover 110 and the transmission module 150 according to the embodiment of FIG. 1. In FIGS. 7 and 8, the cover body 140 along with the horizontal sliding portion 120 and the tilt sliding portion 130 are horizontally disposed in the cover 110, and then the cover 110 along with the horizontal sliding portion 120, the tilt sliding portion 130 and the cover body 140 are horizontally disposed on the transmission module 150.

In FIG. 4, the transmission module 150 can further include a track main body 152, at least one transmission member 153, a tonner outlet passage 154 and two valves 155. In particular, according to the embodiment of FIG. 1, a number of the transmission members 153 is two, and the transmission members 153 are disposed on two sides of the toner outlet passage 154, but are not limited thereto.

Figure 9:
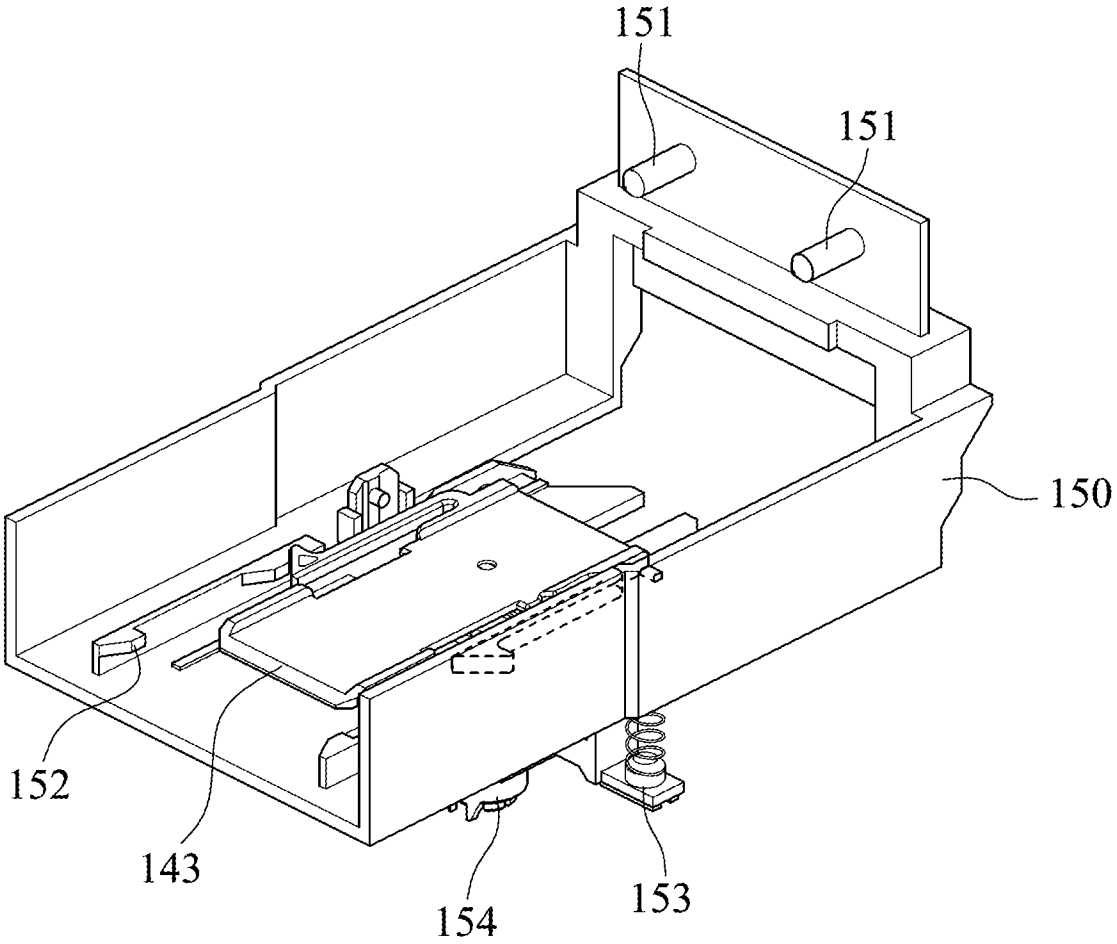
FIG. 9 is a schematic view of a sliding sheet engaged with the track main body according to the embodiment of FIG. 1.

FIG. 9 is a schematic view of a sliding sheet 143 engaged with the track main body 152 according to the embodiment of FIG. 1. In FIG. 9, the sliding sheet 143 of the cover body 140 is engaged with the track main body 152 of the transmission module 150, and a toner outlet (its reference numeral is omitted) of the sliding sheet 143 is corresponding to the toner outlet passage 154 of the transmission module 150. In detail, when the cover body 140 is horizontally slidden with the horizontal sliding portion 120, the sliding sheet 143 is not moved with the cover body 140. Hence, a relative position between the toner outlet of the sliding sheet 143 and the toner outlet passage 154 of the transmission module 150 can be fixed.

Figure 10:
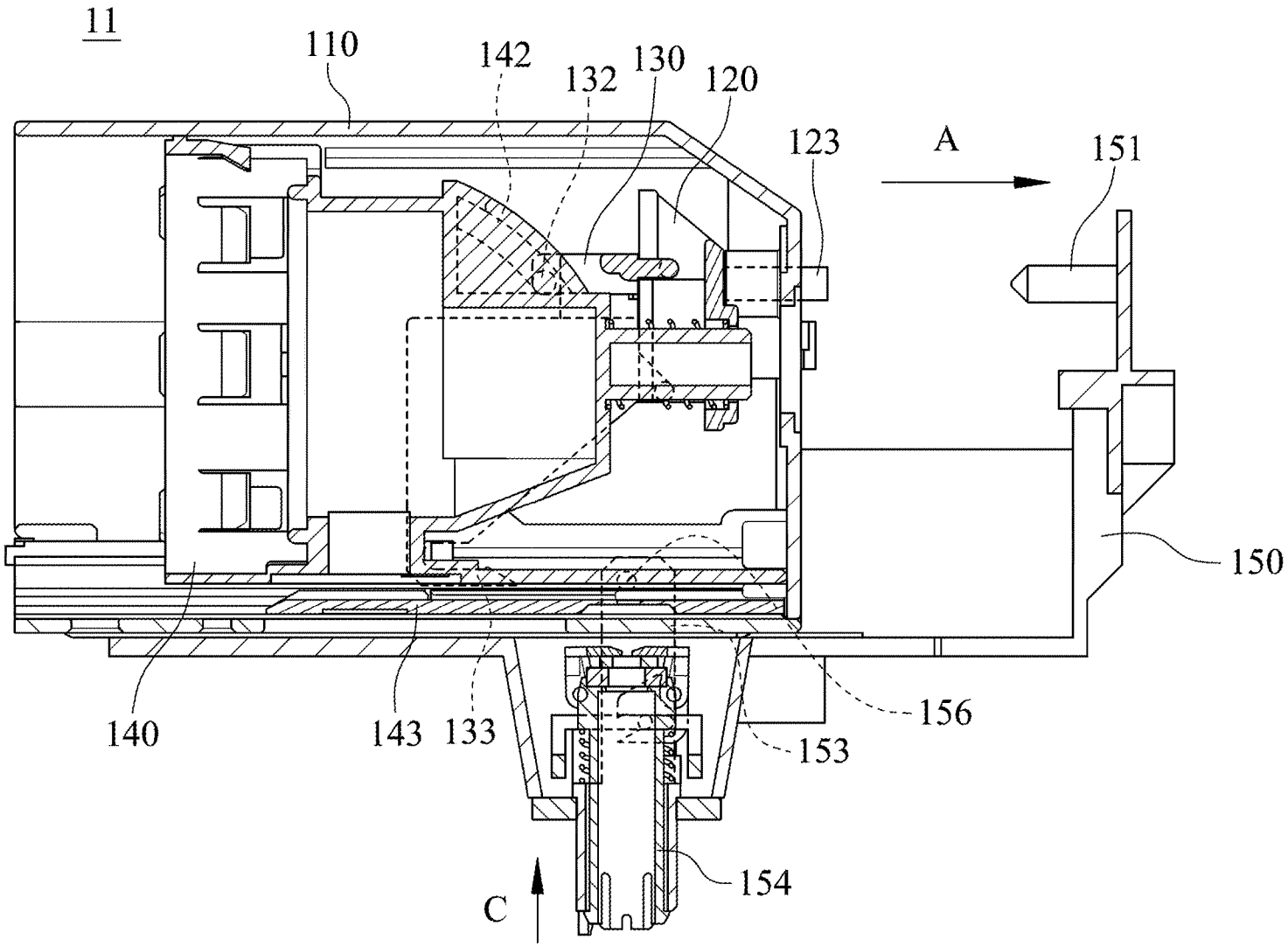
FIG. 10 is a cross-sectional schematic view of an operation of the linking mechanism according to the embodiment of FIG. 1.

FIG. 10 is a cross-sectional schematic view of an operation of the linking mechanism 11 according to the embodiment of FIG. 1. In FIG. 10, the cover 110 is horizontally disposed on the transmission module 150 with the horizontal sliding portion 120, the tilt sliding portion 130 and the cover body 140 along a direction A, and then the sliding sheet 143 of the cover body 140 is fixed on the track main body 152 of the transmission module 150.

Figure 11:
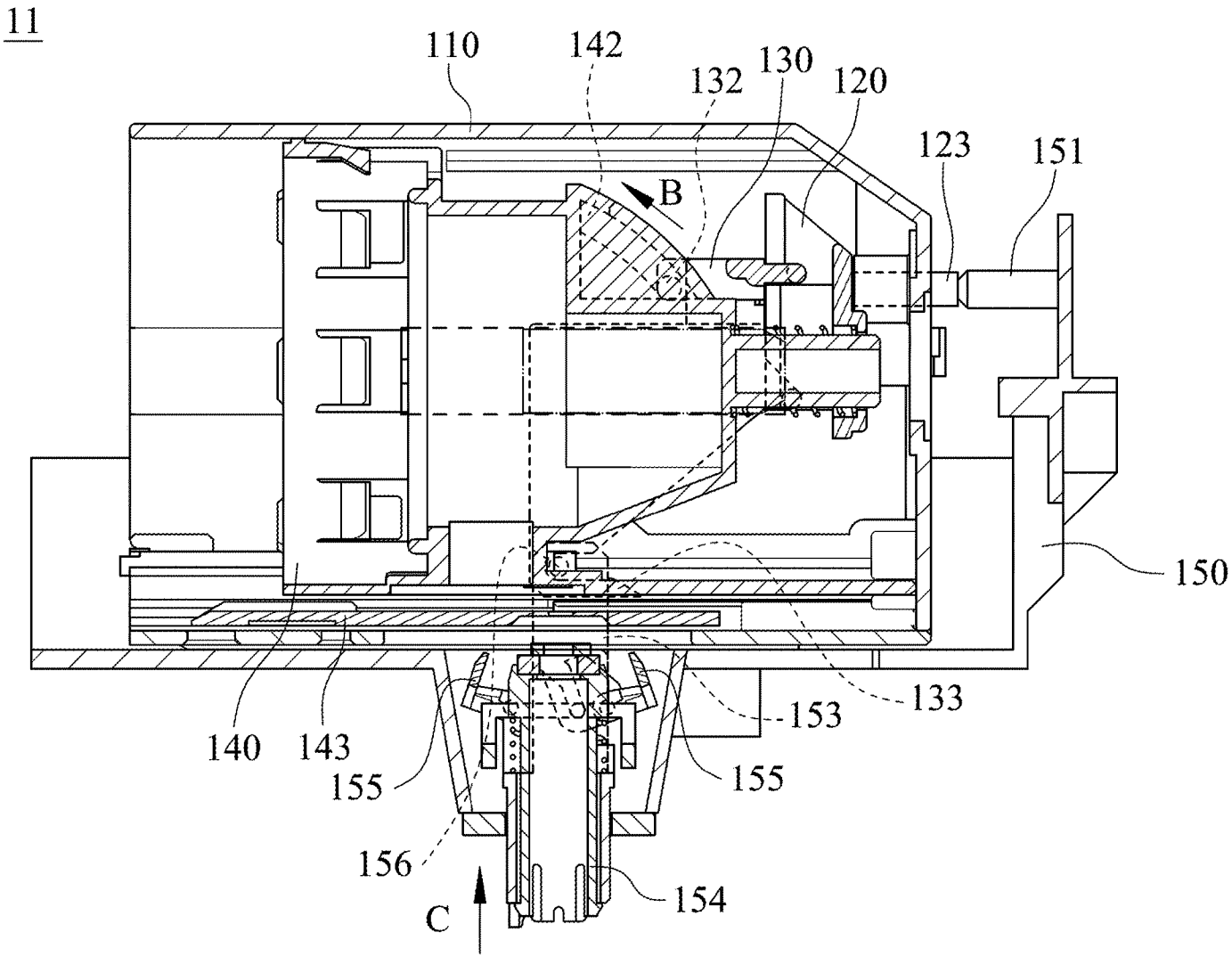
FIG. 11 is another cross-sectional schematic view of an operation of the linking mechanism according to the embodiment of FIG. 1.

Please further refer to FIG. 11, which is another cross-sectional schematic view of an operation of the linking mechanism 11 according to the embodiment of FIG. 1. In FIG. 11, when the horizontal sliding portion 120, the tilt sliding portion 130 and the cover body 140 are linked with the cover 110 to be horizontally slidden along the direction A, the first abutting members 123 of the horizontal sliding portion 120 are abutted to the second abutting members 151 of the transmission module 150 so as to open the valves 155 of the transmission module 150. After the valves 155 of the transmission module 150 are opened, the transmission members 153 and the toner outlet passage 154 can pass the valves 155 along a direction C.

Figure 12:
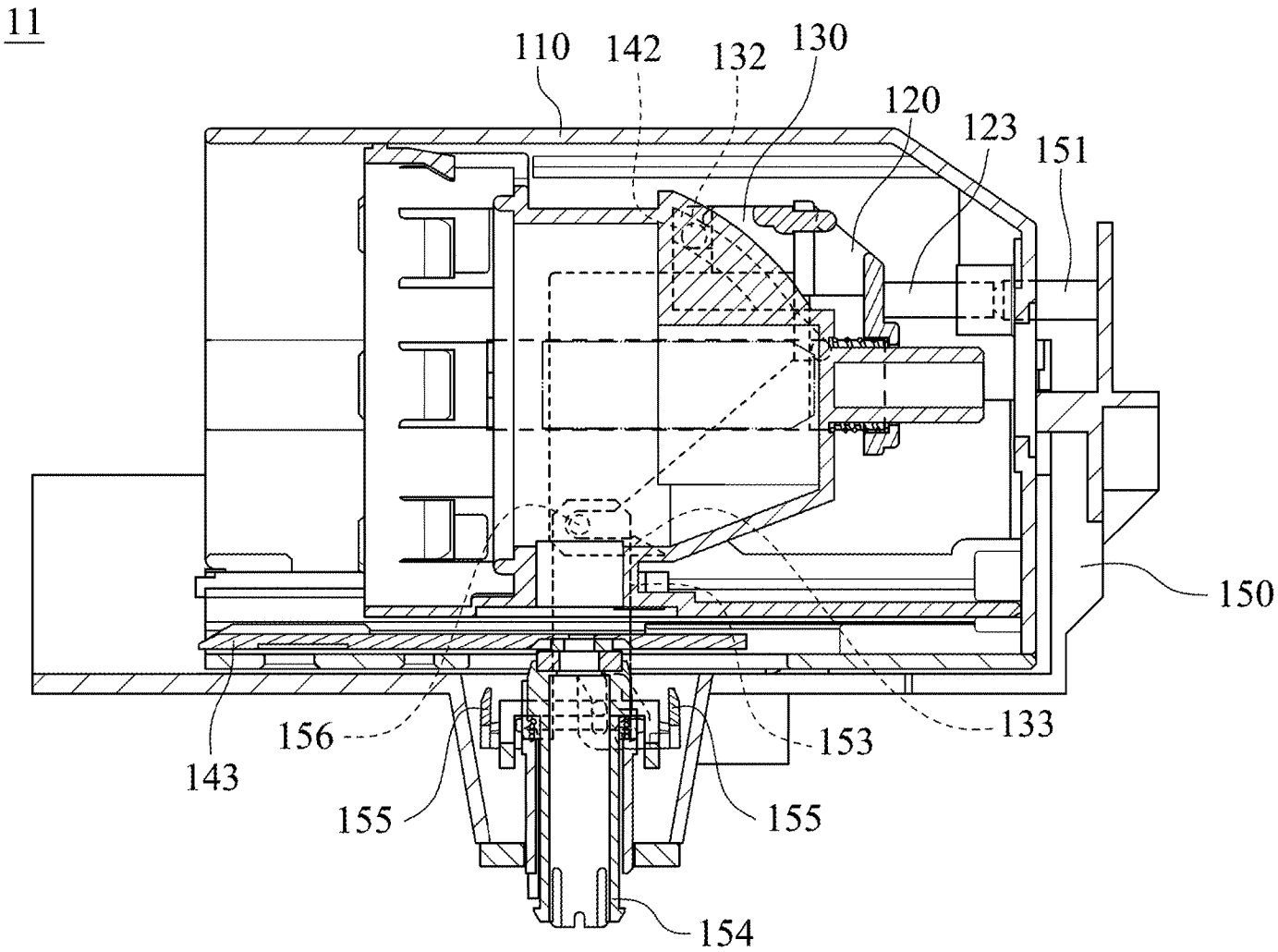
FIG. 12 is still another cross-sectional schematic view of an operation of the linking mechanism according to the embodiment of FIG. 1.

Please further refer to FIG. 12, which is still another cross-sectional schematic view of an operation of the linking mechanism 11 according to the embodiment of FIG. 1. In FIG. 12, when the first abutting members 123 of the horizontal sliding portion 120 are further abutted to the second abutting members 151 of the transmission module 150, the tilt sliding portion 130 is slidden along the track structure 142 of the cover body 140, and the tilt sliding portion 130 is for linking the transmission members 153 and the toner outlet passage 154 to vertically move so as to link the transmission members 153 and the toner outlet passage 154 to move along the direction C. Hence, the transmission members 153 of the transmission module 150 are connected to the tilt sliding portion 130, and the toner outlet passage 154 is connected to the toner outlet of the sliding sheet 143. In particular, according to the embodiments of FIGS. 10 to 12, each of the transmission members 153 of the transmission module 150 has a bump 156, each side of the tilt sliding portion 130 has a hook structure 133, and the transmission members 153 are connected to the tit sliding portion 130 by a connection between the bumps 156 and the hook structures 133. Therefore, the connection between the tilt sliding portion 130 and the transmission members 153 can be more stable by the hook structures 133 of the tilt sliding portion 130 connected to the bumps 156 of the transmission members 153, but the connection form is not limited thereto.

In FIG. 12, by the connection between the transmission members 153 and the tilt sliding portion 130, the toner outlet passage 154 is linked to and corresponding to the toner outlet of the sliding sheet 143 of the cover body 140, so that the toner can be smoothly discharged from the toner cartridge 10.

The foregoing description, for purpose of explanation, has been described with reference to specific embodiments. It is to be noted that Tables show different data of the different embodiments; however, the data of the different embodiments are obtained from experiments. The embodiments were chosen and described in order to best explain the principles of the disclosure and its practical applications, to thereby enable others skilled in the art to best utilize the disclosure and various embodiments with various modifications as are suited to the particular use contemplated. The embodiments depicted above and the appended drawings are exemplary and are not intended to be exhaustive or to limit the scope of the present disclosure to the precise forms disclosed. Many modifications and variations are possible in view of the above teachings.

What is claimed is:

1. A linking mechanism for a toner cartridge, comprising:

a cover, having an accommodating space for disposing a toner cylinder;

a horizontal sliding portion, wherein the horizontal sliding portion is horizontally slidden when the toner cartridge is installed or disassembled, and is slidably connected to the cover;

a tilt sliding portion, wherein when the horizontal sliding portion is slidden, the tilt sliding portion is driven to rise or decline directly by the horizontal sliding portion; and a cover body, having a hollow tunnel portion for connecting to the toner cylinder, and the tilt sliding portion slidably connected to the cover body;

wherein the tilt sliding portion comprises at least one first engaging structure slidably connected to the at least one first engaging structure, and the tilt sliding portion moves relatively to the horizontal sliding portion during an operation of the linking mechanism;

wherein the cover body comprises a track structure disposed on a top of an outer side of the cover body, and the tilt sliding portion further comprises a sliding structure slidably connected to the track structure of the cover body;

wherein the track structure is an arc-shaped track.

2. The linking mechanism for the toner cartridge of claim 1, wherein the cover comprises:

at least one track disposed on the cover.

3. The linking mechanism for the toner cartridge of claim 2, wherein the horizontal sliding portion further comprises:

at least one slideway portion slidably disposed on the at least one track.

4. The linking mechanism for the toner cartridge of claim 1, further comprising:

a transmission module disposed on an outer side of the cover for linking the horizontal sliding portion horizontally slidden.

5. The linking mechanism for the toner cartridge of claim 4, wherein the horizontal sliding portion further comprises at least one first abutting member, the transmission module comprises at least one second abutting member, and the at least one first abutting member is corresponding to the at least one second abutting member.

6. The linking mechanism for the toner cartridge of claim 4, wherein the transmission module comprises a track main body, and a sliding sheet of the cover body is engaged with the track main body of the transmission module.

7. The linking mechanism for the toner cartridge of claim 4, wherein the transmission module further comprises at least one transmission member connected to the tilt sliding portion, and the at least one transmission member is linked to vertically move via the tilt sliding portion.

* * * * *